United States Patent [19]

Powers et al.

[11] Patent Number: 4,708,296

[45] Date of Patent: Nov. 24, 1987

[54] JET KNIFE STRUCTURE

[75] Inventors: Richard G. Powers, Overland Park; Joseph S. Zeets, Olathe, both of Kans.; Joseph G. Currier, Greenwood; Lewis F. Alley, Kansas City, both of Mo.

[73] Assignee: Marlen Research Corporation, Overland Park, Kans.

[21] Appl. No.: 789,080

[22] Filed: Oct. 18, 1985

[51] Int. Cl.[4] ..... B02C 18/30

[52] U.S. Cl. ..... 241/82.2; 241/82.5

[58] Field of Search ..... 241/46.06, 46.08, 46.11, 241/82.1–82.7

[56] References Cited

U.S. PATENT DOCUMENTS

| | | | |
|---|---|---|---|
| 3,399,704 | 9/1968 | Otto | 241/82.5 |
| 3,612,130 | 10/1971 | Pouka | 241/82.5 |
| 4,093,128 | 6/1978 | Barne | 241/82.5 |
| 4,479,614 | 10/1984 | Bernard | 241/82.5 X |

OTHER PUBLICATIONS

Weiler and Company, Weiler, 2/5/84, p. 2.

*Primary Examiner*—Timothy V. Eley

*Attorney, Agent, or Firm*—Schmidt, Johnson, Hovey & Williams

[57] ABSTRACT

A jet-knife assembly for meats or like products is provided which assures even, predictable grinding with a minimum of objectionable fines or agglomerated strings, so as to yield final products of consistent dimensions and characteristics. The overall assembly preferably includes a plate presenting only a single set of circularly arrayed apertures therethrough, together with a cooperating, multiple-blade, rotating knife adjacent the plate; the knife blades each have elongated fluid-conveying channels along the operating faces thereof, which are sized relative to the plate apertures so that the cross-sectional area of the channel is always greater than the total plate open area in communication with the channel during blade rotation. Pressurized steam or air is directed to the blade channels during operations, so that as the knife rotates and blade channels come into communication with the plate apertures, product is expelled or "popped" out of the plate apertures. Provision of non-bridging blade channels assures substantially constant pressure conditions at each plate aperture to yield the most consistent final products.

14 Claims, 8 Drawing Figures

Fig. 1
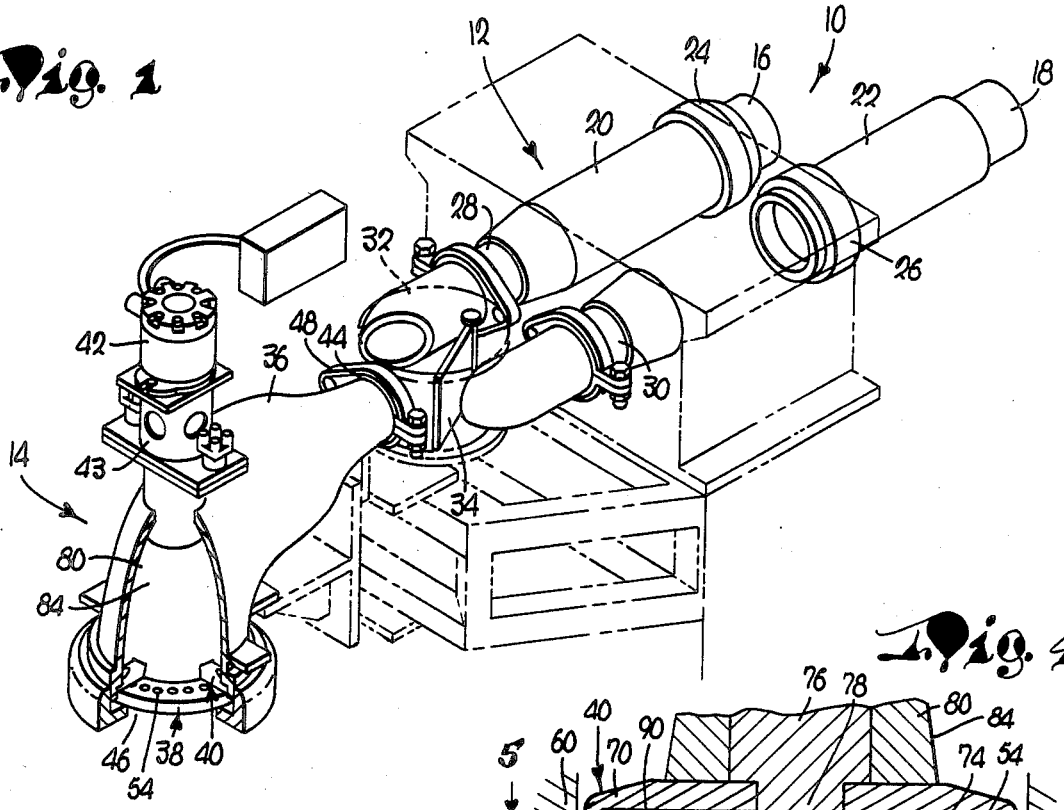
Fig. 4
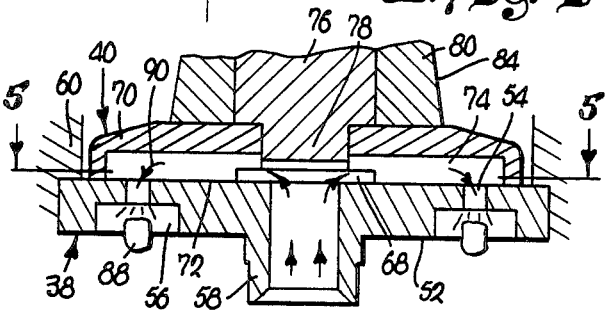
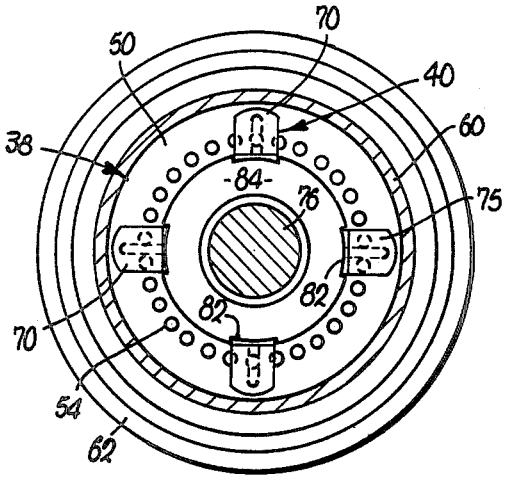
Fig. 3
Fig. 2
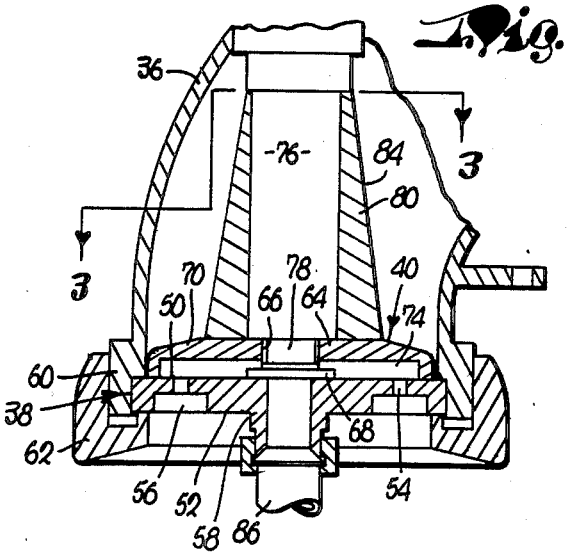

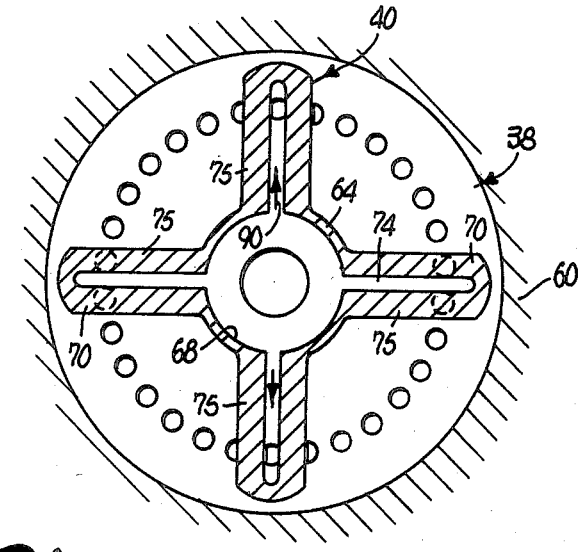
Fig. 5
Fig. 6
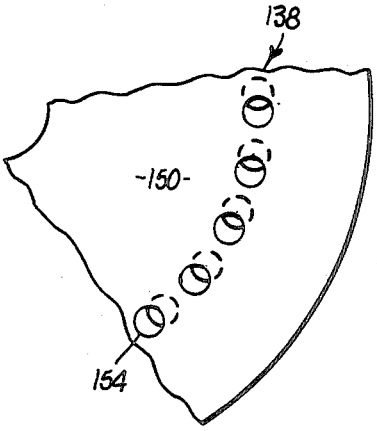
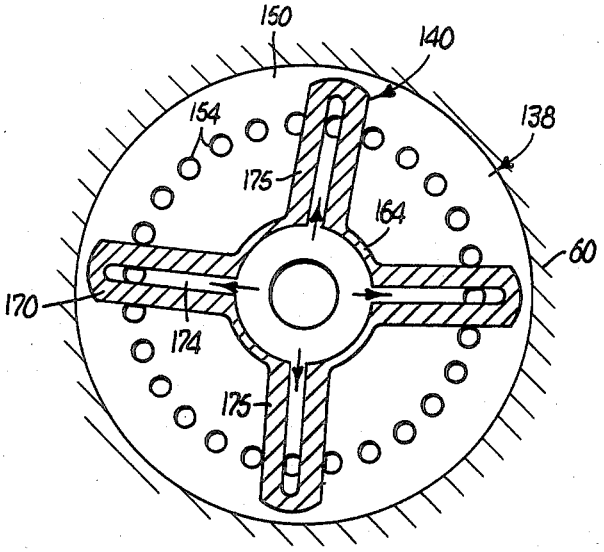
Fig. 7
Fig. 8
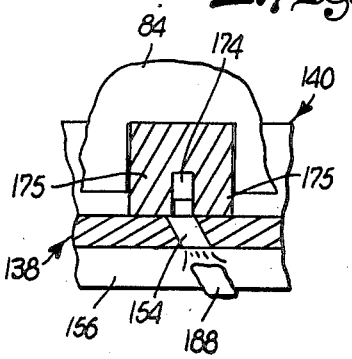

JET KNIFE STRUCTURE

BACKGROUND OF THE INVENTION

1. Field of the Invention

The present invention is broadly concerned with reducing apparatus of the type typically used in the production of chunk-type products, e.g., meats used in chilies, stews and as pizza toppings. More particularly, it is concerned with an improved jet-knife apparatus which makes use of a continuous stream of steam or pressurized air in order to forcibly expel product through an apertured plate.

2. Description of the Prior Art

A wide variety of reducing or comminuting devices have been used in the past to comminute and subdivide meat and other products. These devices vary in complexity and sophistication, depending upon the ultimate product desired. In cases where chunk-type products are to be produced, it has been known to provide grinders equipped with a large circular grinder plate having a series of apertures therethrough, in conjunction with a rotatable, multiple bladed grinder knife. In these devices, incoming product is fed towards and through the grinder plate, and the rotating knife serves to cut the product to a desired size.

In another type of known device, the respective blades are provided with elongated fluid-conveying recesses or channels along the length thereof, and means is provided for delivery of steam or pressurized air to such channels. During rotating of the knife, the blades come into communication with the plate apertures, and the pressurized steam or air expels or "pops" the product from the apertures. This kind of device has been referred to as a "jet-knife" grinder, and has been used in the production of chunk-type meat products.

A prime drawback of prior jet knife assemblies, however, resides in the fact that they are prone to the production of fines or extra long strings of agglomerated meat particles. Fines in this context refers to particles too small for practical use, whereas strings refers to elongated strands of meat likewise not in optimum condition for use. Fines are typically produced by overpressurization at the plate apertures, whereas strings result from low pressure conditions at the apertures. Such unwanted differential pressures at different apertures may result when a given knife blade channel bridges more than one plate opening during rotation, with the combined areas presented by the opening being greater than the cross-sectional area of the knife blade channel. In these situations product can momentarily hang up in the apertures until further fluid pressure is developed in the channel as a result of the blade rotating to a position where the channel cross-sectional area exceeds that of the bridged open areas of the plate; at this point the product may be forcibly ejected from the plate with great velocity, resulting in fines. On the other hand, product hang-up can also cause agglomeration of product within the plate apertures and resultant strings. In short, the problem of pressure differences at the plate apertures can under varying circumstances lead to serious operational problems.

A related difficulty stems from the fact that, with prior jet knife arrangements, the knife operating face on either side of the channel is of insufficient width to completely cover all apertures as the knife rotates. Thus, situations can arise where a given aperture is simultaneously subjected to fluid pressure and to pressure from the stream of product directed towards the plate. This again leads to uneven pressures and the types of problems described above.

SUMMARY OF THE INVENTION

The problems outlined above are in large measure solved by the present invention, which provides an improved jet knife apparatus which virtually eliminates the problem of fines and string production. Broadly speaking, the reducing assembly of the invention includes an apertured plate together with a rotatable knife including a blade. The latter presents an elongated operating face, together with an elongated fluid-conveying channel generally along the length of the operating face thereof. The knife is mounted for rotation proximal to the grinder plate, and with the blade operating surface being adjacent the plate inlet face. Very importantly, minimum cross-sectional area presented by the fluid-conveying channel of the blade is correlated with the size and location of the plate apertures for preventing the channel from communicating at any time during its rotation with an open area defined by the plate apertures which is greater than the channel cross-sectional area. Stated otherwise, at all times the channel cross-sectional area is greater than the sum of all aperture open areas in communication with the channel. In this way, appropriate pressure conditions are maintained to minimize the incidence of fines or strings.

In preferred forms, the fluid-conveying channel of the blade is correlated with the size and location of the plate apertures for preventing bridging of a pair of the apertures by the channel during rotation of the blade. In this fashion, product is expelled from the plate at substantially the same pressure. Hence, the invention avoids undue differential pressures between respective plate apertures, and thereby minimizes problems of hang-ups of product causing strings, as well as overpressures leading to fines.

In preferred forms, the assembly of the invention includes a plate presenting only a single, circularly arrayed set of grinding apertures therethrough, although other arrangements such as multiple circular arrays could be employed.

It is also preferred that the blade operating face be of sufficient width to successively cover all apertures during knife rotation; in this way the apertures do not simultaneously experience both fluid pressure from the blade channel and product pressure as well. The knife includes a central hub defining the rotational axis of the knife, with a plurality of outwardly extending blades secured to the hub. Additionally, a tapered, product-directing element is rotatable with the knife and serves to divert the flow of product into the grinder towards the circularly arranged apertures.

In other aspects of the invention, use can be made of blades extending radially outwardly from the central hub and in an equidistantly spaced relationship to one another; alternately, the blades can be non-radially oriented and differentially spaced so as to produce product of differing dimensions. Finally, if desired the plate can be equipped with obliquely oriented grinding apertures, so that product passing through the plate is directed in an expanded pattern as compared with conventional axial (i.e., straight through) plate apertures. This spreads the product over a wider area on a receiving belt or the like, which is advantageous during downstream processing operations.

DESCRIPTION OF THE DRAWINGS

FIG. 1 is a partially schematic, perspective view with parts broken away for clarity depicting a reducing assembly in accordance with the present invention operably coupled with a dual piston pumping unit for delivery of product to the assembly;

FIG. 2 is an enlarged, fragmentary view in vertical section illustrating details of the preferred assembly;

FIG. 3 is a sectional view taken along line 3—3 of FIG. 2;

FIG. 4 is a fragmentary view in vertical section illustrating the operation of the jet knife assembly of the invention in the formation of meat products;

FIG. 5 is a sectional view taken along line 5—5 of FIG. 4 which depicts the cooperating relationship between the knife and plate of the assembly;

FIG. 6 is a fragmentary view of another embodiment of the invention, illustrating a plate having obliquely oriented apertures therethrough;

FIG. 7 is a view similar to that of FIG. 5, but illustrates the use of the FIG. 6 plate in conjunction with a knife having non-symmetrically arranged blades; and FIG. 8 is an enlarged fragmentary view illustrating the operation of the assembly depicted in FIG. 7.

DESCRIPTION OF THE PREFERRED EMBODIMENTS

Turning now to the drawings, and particularly FIG. 1, a product processing assembly 10 is illustrated which broadly includes a dual piston pump 12 and a jet knife grinder 14 in accordance with the present invention. As can be readily appreciated, the grinder 14 is operatively coupled to the output of pump 12, in order to receive product and process the same for downstream operations such as cooking.

In more detail, the pump 12 is designed to supply a continuous flow of product of pressures of up to about 500 pounds per square inch. The depicted pump is manufactured by the Marlen Research Corporation of Overland Park, Kan. Broadly speaking, the pump 12 includes a pair of pistons 16, 18 that are alternately reciprocal within moveable sleeves 20, 22, respectively. Sleeves 20 and 22 are slidable within guide rings 24 and 26, respectively. The pistons 16, 18 in the sleeves 20, 22 reciprocate within a feeding chamber (not shown) which has the incoming product fed thereto. As the sleeve 20 and the sleeve 22 reciprocate forward into the feeding chamber, they connect with output tubes 28 and 30, respectively. The output tubes 28, 30 are fed to a mixing chamber 32 including a diverter valve 34 for providing one-way flow from output tubes 28, 30 into mixing chamber 32.

In operation, the sleeve 20 is shifted forwardly (typically by means of conventional hydraulic drive structure) ahead of the pistons 16 to capture a charge of meat or other product within the sleeve and to thereby define a cylinder load. The piston 16 is then advanced through the sleeve 20 to create a positive pressure therein, thereby forcibly ejecting the charge of product within the sleeve 20 to the output tube 28 and into mixing chamber 32. At the same time, the sleeve 22 and piston 18 are retracted in the feeding chamber so that product is drawn into the feeding chamber by suction. Since this is a slight negative pressure and the particulate matter within the output tube 28 is subjected to positive pressure, valve 34 is operable to block off flow through the output tube 30 from the mixing chamber 32. Upon complete extension of the piston 16 within the sleeve 20, the piston 16 is retracted along with the sleeve 20 and the piston 18 in sleeve 22 are advanced forward in the same manner as described. In this way, a continuous flow of product is maintained into the mixing chamber.

The grinder 14 is generally of the type described in U.S. Pat. No. 4,479,614, and this patent is hereby incorporated by reference herein. Generally, however, the grinder 14 includes a chamber 36 housing an apertured plate 38 and a rotatable knife 40. A variable speed motor 42 also forms a part of the overall assembly, and is coupled by means of a drive assembly 43 to the knife 40 for rotation of the latter.

The collection chamber 36 is of somewhat frustoconical configuration and has an inlet port 44 and an outlet 46. The inlet port 44 is connected to the output of mixing chamber 32 by means of collar 48. The walls of chamber 36 taper outwardly from the inlet port and make an essentially right angle bend to the outlet port 46 to provide an overall expanding chamber. The collection chamber 36 is thus operable to receive the output of the mixing chamber 32 and allow for an expansion of volume for further processing the meat or other product therein.

Referring specifically to FIGS. 2–5, it will be observed that the plate 38 includes an inlet face 50 and an opposed outlet face 52. In addition, the plate is provided with a single set of circularly arranged, axially extending apertures 54 therethrough. These apertures communicate with an annular recess 56 provided in the outlet face 52 of the plate. Moreover, the plate includes a central, tubular, downwardly extending hub 58 which is important for purposes to be described. The plate 38 is maintained in a stationary condition within housing 36 by means of its captive retention between ledge 60 adjacent the lower end of chamber 36, and bottommost connector ring 62 which is threadably secured to the chamber 36 as depicted.

Knife 40 includes a central hub 64 which presents a square uppermost opening 66 and a circular, central recess 68 adjacent the lower surface thereof. As best seen in FIGS. 2 and 4, the recess 68 has a larger diameter than the bore of hub 58.

The knife 40 also includes a plurality (here four) of radially outwardly extending blades 70 which are integral with hub 64, and, in this embodiment, are equidistantly spaced from one another. The blades are identical, and each includes a lowermost operating face 72 presenting an elongated fluid-conveying recess or channel 74 along the length thereof which communicates with central hub recess 68 and a pair of flattened lands 75 on either side of the channel 74. It will be observed that the channels 74 are of sufficient length to extend past and cover the apertures 54 during rotation of the knife; and that the width of any land 75 is greater than the diameter of any plate aperture 54. In addition, it will be noted that the knife is mounted with operating faces 72 of the blades 70 adjacent the inlet or upper face 50 of the plate 38.

The knife 40 is mounted for rotation about its central axis on a shaft 76 forming a part of the drive assembly 43. The shaft 76 includes a square lowermost projection 78 which is received within similarly configured opening 66 of hub 64 to assure a good driving connection.

The overall drive assembly 43 further includes an elongated, upright, tubular diverter element 80 having recesses 82 adjacent the lower end thereof for receiving the outwardly projecting blades 70. The element 80 is centrally bored as illustrated, and receives the shaft 76. Hence, it will be appreciated that the element 80 rotates in unison with knife 40, by virtue of the interlocking fit between the element and the blades 70. In addition, the element 80 includes a tapered, frustoconical outer diversion surface 84 which terminates slightly inboard of the circularly arranged apertures 54. In this fashion, meat or other product delivered to housing 36 is diverted radially outwardly relative to the hub 64 of rotating knife 40, so as to assure even flow of product to the apertures 54.

Steam or pressurized air is continuously supplied to the grinder assembly, and particularly to the channels 74 of blades 70, through a conduit 86 operably coupled to the lowermost end of tubular hub 58. As will be readily appreciated, a source of steam or pressurized air (not shown) is operably coupled to the remote end of conduit 86.

In the operation of the assembly, meat or other product is delivered to the inlet 44 of housing 36, and is thence fed under pressure towards plate 38 and knife 40. Simultaneously, motor 42 is activated in order to rotate the knife 40. As the product approaches the plate 38, such product is diverted outwardly by means of the diverter element 80 towards and through the apertures 54. During rotation of the knife 40, the blades 70 thereof successively cut or shear the product passing through the apertures 54. Moreover, as the channels 74 of the respective blades 70 come into communication with the openings 54, fluid pressure within the channel serves to expel or "pop" the product from the apertures. This action is illustrated in FIG. 4, where it will be seen that a plug or piece of product 88 is expelled from the associated plate apertures 54 by virtue of fluid pressure developed within the channels 74. Such fluid pressure is depicted by means of the arrows 90.

It is of particular importance that the cross-sectional area of the channels 74 are correlated with the size and location of the plate apertures 54 so as to prevent any channel 74 from coming into communication at any time with a total open plate area defined by the apertures 54 greater than the channel cross-sectional area. In the depicted embodiment, the width of the channels 74 is correlated with the size and location of the openings to prevent bridging of a pair of the apertures 54 by a channel 74 during rotation of the associated blades 70. Thus, during rotation of a given blade 70, the channel 74 provided with the blade can come into communication with only a single plate aperture 54 at a time. In this way, substantially constant expulsion pressures are generated for all of the plate apertures, and this has been found to materially decrease the incidence of fines or string in the final product. In the case of the particular knife and plate arrangement depicted in FIGS. 1–5, it will be seen that the channels 74 and apertures 54 are arranged so that a pair of opposed, oppositely extending blades 70 can simultaneously communicate with individual apertures 54; however, the other two channels are between adjacent pairs of apertures 54 at this time (see FIG. 3). This further serves to enhance the pressure generated within the channels 74 during the actual expulsion sequence. Also, the lands 75, being wider than the diameter of the apertures 54, completely cover these apertures during rotation of the blade. This provides further pressure equalization as described.

FIGS. 6–8 disclose another embodiment in accordance with the invention. In this embodiment, a plate 138 is provided together with a knife 140. The plate 138 includes the identical hub and boss structure of the first-described embodiment, but in this case the grinding apertures 154 therethrough are obliquely oriented as best seen in FIG. 6. Furthermore, while the knife 140 includes the same hub 164 as the first-described knife 40, the blades 170 forming a part of the overall knife 140 are oriented in a non-radial fashion, and are spaced non-symmetrically relative to one another. The blades 170 do include elongated channels 174 and wide lands 175, but in this particular embodiment the channels 174 are arranged so that all channels can simultaneously communicate with a single aperture 154. Nevertheless, the cross-sectional area of each channel 174 is correlated with the size and location of the openings 154 to prevent a situation where the channel communicates with a greater plate open area than the channel cross-sectional area. Here again, in this embodiment, the channels are configured to prevent simultaneous bridging of a pair of the openings by a single channel 174. The operation of the embodiment of FIGS. 6–8 is in most respects identical to that described above in connection with the embodiment of FIGS. 1–5. The essential difference in the operation of this second embodiment stems from the fact that as the product pieces or plugs 188 (see FIG. 8) are expelled from plate 138, they are ejected non-axially, i.e., in a somewhat circular pattern. It has been found that this type of product delivery from the plate 138 spreads the product over a larger area than would otherwise be the case. This in turn facilitates downstream processing (which may include cooking of the meat pieces 188) by avoiding undue concentration of the ground product over a relatively small area.

We claim:

1. A reducing assembly comprising:

a plate presenting an inlet face and an outlet face, and a plurality of apertures therethrough;

a knife including a blade presenting an elongated operating face, there being structure defining an elongated fluid-conveying channel generally along the length of said operating face and having a closed outermost end;

means mounting said knife for rotation thereof proximal to said plate with said blade operating face being adjacent said plate inlet face, said channel presenting a cross-sectional area taken along a section transverse to the longitudinal axis of said channel, said channel being in communication with successive ones of said apertures during said rotation of said blade such that said channel is in communication with successive aperture-defined open areas, the maximum area of said aperture-defined open areas in communication with said channel at any time during rotation of said blade being no greater than said channel cross-sectional area; and means for introducing prressurized fluid into said channel during rotation of said blade for in turn introducing said fluid from said channel into said apertures during rotation of said blade.

2. The assembly of claim 1, said plate presenting only a single, circularly arrayed set of apertures therethrough.

3. The assembly of claim 1, said knife including a central hub defining the rotational axis of said knife, and a plurality of outwardly extending blades secured to said hub.

4. The assembly of claim 1, said fluid-introduction means comprising a fluid conduit through said plate and communicating with said channel.

5. The assembly of claim 1, including means for directing product toward said apertures.

6. The assembly of claim 5, said product-directing means comprising an elongated element presenting a smoothly tapered, product-directing face, said element being mounted for rotation with said knife.

7. The assembly of claim 1, said knife comprising a hub presenting the rotational axis of the knife, there being a plurality of blades presenting respective operating faces secured to the hub for rotation therewith, each of said blades including structure defining an elongated fluid-conveying channel generally along the length of the operating face thereof, said fluid-introduction means comprising a conduit through said plate, said conduit being in communication with the channels of said blades.

8. The assembly of claim 7, said blades being radially oriented relative to said hub.

9. The assembly of claim 7, said blades being equidistantly spaced from one another.

10. The assembly of claim 7, said blades being non-equidistantly spaced from one another.

11. The assembly of claim 1, said apertures extending axially through said plate.

12. The assembly of claim 1, said channel being configured for preventing bridging of a pair of said apertures by the channel during blade rotation.

13. The assembly of claim 1, said apertures extending obliquely through said plate.

14. The assembly of claim 1, said operating face also presenting a pair of elongated lands respectively on opposite sides of said channel, said lands being of a width greater than the diameter of any of said apertures.

* * * * *